US011118869B1

(12) United States Patent
Gillespie et al.

(10) Patent No.: US 11,118,869 B1
(45) Date of Patent: Sep. 14, 2021

(54) MULTISPECTRAL CAMOUFLAGE FABRIC

(71) Applicant: Milliken & Company, Spartanburg, SC (US)

(72) Inventors: Michael C. Gillespie, Easley, SC (US); Nathan B. Emery, Spartanburg, SC (US)

(73) Assignee: Milliken & Company, Spartanburg, SC (US)

( * ) Notice: Subject to any disclaimer, the term of this patent is extended or adjusted under 35 U.S.C. 154(b) by 155 days.

(21) Appl. No.: 15/211,694

(22) Filed: Jul. 15, 2016

Related U.S. Application Data

(63) Continuation of application No. 15/050,596, filed on Feb. 23, 2016, now abandoned.

(51) Int. Cl.
*F41H 3/02* (2006.01)
*D06M 11/74* (2006.01)
(Continued)

(52) U.S. Cl.
CPC ..... *F41H 3/02* (2013.01); *D06M 11/74* (2013.01); *D06M 13/123* (2013.01);
(Continued)

(58) Field of Classification Search
CPC ..... C09C 2210/00–60; D03D 1/0047; D06M 11/74; D06M 13/123; D06M 13/355;
(Continued)

(56) References Cited

U.S. PATENT DOCUMENTS 4,095,940 A * 6/1978 Weingarten ..... D06P 1/004 8/483
4,495,239 A 1/1985 Pusch et al. ..... 428/192
(Continued)

FOREIGN PATENT DOCUMENTS

CN 101628644 B 3/2011
JP H01297462 A * 11/1989
(Continued)

OTHER PUBLICATIONS

Rouette, Hans-Karl. "Dyeing of Cotton." Encyclopedia of Textile Finishing. Woodhead Publishing, 2001. 132. Retrieved from https://app.knovel.com/hotlink/toc/id:kpETF00001/encyclopedia-textile/encyclopedia-textile (Year: 2001).*
(Continued)

*Primary Examiner* — Laura C Powers
*Assistant Examiner* — Larissa Rowe Emrich
(74) *Attorney, Agent, or Firm* — Cheryl Brickey

(57) ABSTRACT

A multispectral camouflage fabric having a camouflage pattern containing a least a first, second, and third color. Each of the first, second, and third colors contain at least one dye and at least one of the first, second, and third colors contains carbon black. The camouflage pattern has a short wave infrared (SWIR) reflectance pattern and contains first, second, and third reflectance zones. Each reflectance zone has an upper and lower reflectance zone boundary and the difference between the upper and lower first reflectance zone boundaries is approximately 10 percentage points. The difference between the first and second zone and the second and third zone is approximately 10 percentage points. At essentially all wavelengths within the SWIR portion of the spectrum, the first color falls within the first zone boundaries, the second color falls within the second zone boundaries, and the third color falls within the third zone boundaries.

15 Claims, 6 Drawing Sheets

(51) Int. Cl.
*D06M 101/16* (2006.01)
*D06M 13/355* (2006.01)
*D06M 13/123* (2006.01)

(52) U.S. Cl.
CPC ..... *D06M 13/355* (2013.01); *D06M 2101/16* (2013.01); *D06M 2200/30* (2013.01)

(58) Field of Classification Search
CPC ..... D06M 2101/16; D06M 2200/30; D06P 1/004; D06P 1/0076; D06P 1/0096; D06P 1/16–28; D06P 1/38–40; F41H 3/00–02
USPC ..... 428/919; 2/900
See application file for complete search history.

(56) References Cited

U.S. PATENT DOCUMENTS

| | | | | |
|---|---|---|---|---|
| 5,798,304 | A * | 8/1998 | Clarkson | B32B 27/12 442/289 |
| 5,955,175 | A | 9/1999 | Culler | 428/209 |
| 6,127,007 | A | 10/2000 | Cox et al. | 428/15 |
| 7,008,694 | B1 * | 3/2006 | Frankel | D01D 5/253 428/364 |
| 7,102,814 | B1 | 9/2006 | Hughes | 359/350 |
| 7,135,424 | B2 | 11/2006 | Worley et al. | 442/131 |
| 7,163,580 | B2 | 1/2007 | Minami | 106/404 |
| 7,244,684 | B2 | 7/2007 | Hexels | 442/64 |
| 7,455,904 | B2 | 11/2008 | O'Keefe | 428/403 |
| 7,832,018 | B2 | 11/2010 | Schwarz | 2/69 |
| 7,846,510 | B2 | 12/2010 | Afshar | 427/419.1 |
| 7,901,756 | B2 | 3/2011 | Burr et al. | 428/123 |
| 8,333,863 | B2 | 12/2012 | Kelsey et al. | 156/278 |
| 8,404,330 | B2 | 3/2013 | Bletsos et al. | 427/137 |
| 8,779,964 | B2 | 7/2014 | Kelsey et al. | 342/3 |
| 8,883,905 | B2 | 11/2014 | Takano et al. | 524/441 |
| 8,916,265 | B1 | 12/2014 | Kelsey et al. | 428/316.6 |
| 8,918,919 | B2 | 12/2014 | Scholz | 2/458 |
| 8,932,965 | B1 | 1/2015 | Wendel | 442/59 |
| 9,005,741 | B1 | 4/2015 | Hoffer et al. | 428/196 |
| 9,062,938 | B1 * | 6/2015 | McIntosh | F41H 3/02 |
| 2004/0116025 | A1 | 6/2004 | Gogins | |
| 2006/0128243 | A1 | 6/2006 | Kong | |
| 2009/0214852 | A1 | 8/2009 | Kelsey | |
| 2009/0263644 | A1 * | 10/2009 | Kelsey | F41H 3/00 428/315.9 |
| 2010/0224402 | A1 | 9/2010 | Lim | |
| 2010/0263109 | A1 | 10/2010 | Noerenberg et al. | 2/456 |
| 2011/0065347 | A1 | 3/2011 | Havird | |
| 2012/0288662 | A1 | 11/2012 | Conolly | 428/87 |
| 2013/0212789 | A1 | 8/2013 | Conolly et al. | 2/458 |
| 2014/0154482 | A1 | 6/2014 | Jang | 428/196 |
| 2014/0205798 | A1 | 7/2014 | Williams et al. | 428/138 |
| 2014/0227552 | A1 | 8/2014 | Lau et al. | 428/621 |
| 2014/0242355 | A1 | 8/2014 | Castille | 428/196 |
| 2014/0304883 | A1 | 10/2014 | Morag et al. | 2/69 |
| 2014/0356574 | A1 | 12/2014 | Conolly | 428/138 |

FOREIGN PATENT DOCUMENTS

| | | | |
|---|---|---|---|
| JP | H03205463 A | * | 9/1991 |
| JP | 200453039 | | 2/2004 |
| JP | 2004053039 A | * | 2/2004 |
| JP | 3572173 B2 | | 9/2004 |

OTHER PUBLICATIONS

"JP2004053039_Machine Translation" is a machine translation of JP 2004-053039A. (Year: 2004).*

"JPH01297462_Machine Translation" is a machine translation of JP H01-297462A. (Year: 1989).*

"JPH03205463_Machine Translation" is a machine translation of JP H03-205463A. (Year: 1991).*

Complete Textile Glossary, Woven Fabric, Celanese Acetate LLC. (Year 2001) 212 pages.

Eckart, "IReflex" Product Information, Sep. 22, 2015 <https://web.archive.org/web/20150922064827/http://www.eckart.net.coatings/industrial-coatings/wood-coatings/aqueous-systems/functiona;/ireflex.html> 2 pages.

Mehrizi, M. Khajeh, et al. "Effect of Carbon Black Nanoparticles on Reflective Behavior of Printed Cotton/Nylon Fabrics in Visible/near Infrared Regions." Fibers and Polymers, vol. 13, No. 4, May 3, 2012, pp. 501-506., doi: 10.1007/s12221-012-0501-5. (Year: 2012).

* cited by examiner

MULTISPECTRAL CAMOUFLAGE FABRIC

RELATED APPLICATIONS

This application is a Continuation of co-pending U.S. patent application Ser. No. 15/050,596 filed on Feb. 23, 2016, which is herein incorporated by reference in its entirety.

TECHNICAL FIELD OF THE INVENTION

The present invention is directed towards fabrics for use in multispectral camouflage products.

BACKGROUND

Camouflage fabrics are typically used to reduce the discoverability of a soldier in the visible and near infrared region of the electromagnetic spectrum. However, as technology advances and imaging devices become more advanced and readily available, there is now a need to protect the soldier from detection in a larger range of the electromagnetic spectrum including the short wave infrared region.

BRIEF SUMMARY OF THE INVENTION

A multispectral camouflage fabric comprising a fabric having a first side and a second side and a camouflage pattern on at least the first side of the fabric. The camouflage pattern contains a least a first color, a second color, and a third color. Each of the first, second, and third colors contains at least one dye and at least one of the first, second, and third colors contains carbon black. The camouflage pattern comprises a short wave infrared (SWIR) reflectance pattern through the SWIR portion of the spectrum defined to be between 900 and 2000 nm, where the SWIR reflectance pattern contains a first reflectance zone, a second reflectance zone, and a third reflectance zone. Each reflectance zone has an upper and lower reflectance zone boundary and the difference between the upper and lower first reflectance zone boundaries is approximately 10 percentage points. The difference between the first upper reflectance zone boundary and the second lower reflectance zone boundary is approximately 10 percentage points and the difference between the second upper reflectance zone boundary and the third lower reflectance zone boundary is approximately 10 percentage points. At essentially all wavelengths within the SWIR portion of the spectrum, the first color falls between the first lower and upper reflectance zone boundaries, the second color falls between the second lower and upper reflectance zone boundaries, and the third color falls between the third lower and upper reflectance zone boundaries.

DETAILED DESCRIPTION

Camouflage patterns are designed to blend with the background so that whatever is behind the camouflage is obscured from view. Prior to the 1980's, the main concerns were in the visible and near infrared portions of the spectrum. With the advent of detection technology in the short wave infrared (SWIR), there has become a need to extend the camouflage protection into these wavelengths. In the visible region, the color of the camouflage must somewhat match the surroundings. It has been shown that using multiple colors in a pattern provides improved blending with the background if the background is not a single color. The pattern chosen must provide break up similar in scale to the background. In the near infrared region, the portions of the pattern must reflect similar to the background as the detection device is using reflected light to form an image. Typical reflectance values range from about 10% for dark colors to about 70% for light colors. The same is true in the SWIR portion of the spectrum defined to be between 900 and 2000 nm.

Figure 1:
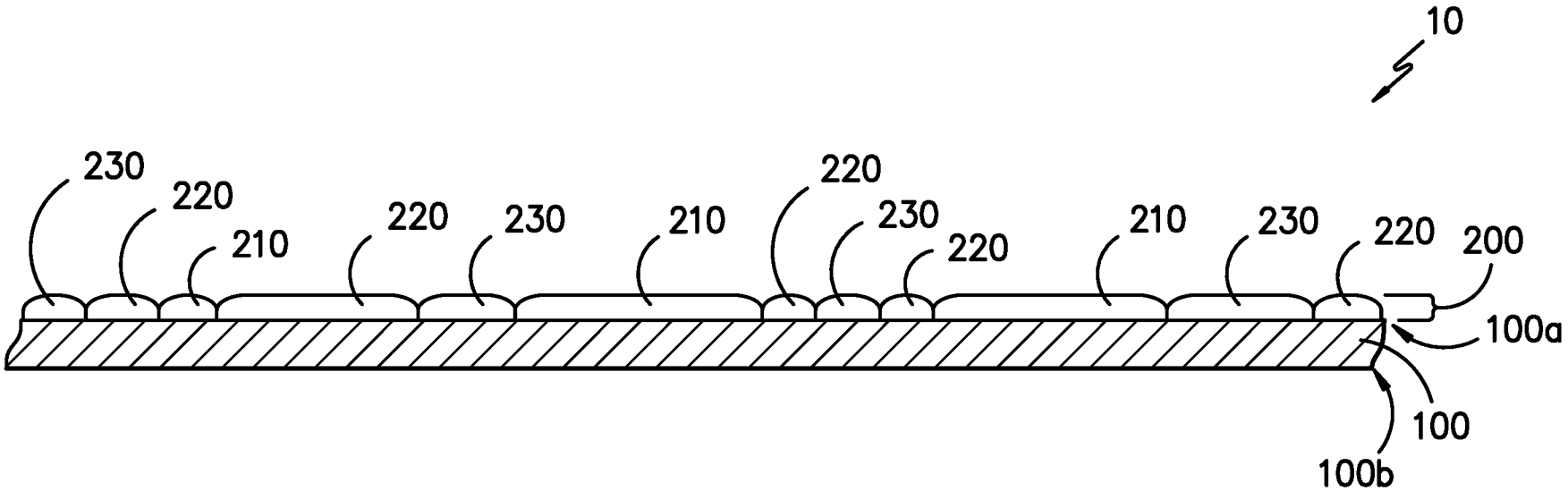
FIG. 1 illustrates a cross-sectional view of one embodiment of the multispectral camouflage fabric.

Referring now to FIG. 1, the multispectral camouflage fabric 10 contains a fabric 100 having a first side 100*a* and a second side 100*b*. Typically the fabric 10 is oriented such that the first side of the fabric 100*a* is the outer facing side of the fabric 100 (for example, if the multispectral camouflage fabric 10 was made into a jacket, the first side 100*a* of the fabric 100 would be the outer facing side of the jacket such that it could be seen by others). The multispectral camouflage fabric 10 also contains a camouflage pattern 200 on at least the first side 100*a* of the fabric 100. The camouflage pattern 200 contains at least a first color 210, a second color 220, and a third color 230.

In one embodiment, the fabric 100 is a woven fabric. The weave may be, for example, plain, satin, twill, basket, poplin, jacquard, or crepe. Preferably, the fabric materials are provided in a woven construction, such as a plain weave, basket weave, twill weave, satin weave, or sateen weave. Suitable plain weaves include, but are not limited to, rip stop weaves produced by incorporating, at regular intervals, extra yarns or reinforcement yarns in the warp, fill, or both the warp and fill of the fabric material during formation. Suitable twill weaves include both warp-faced and fill-faced twill weaves, such as 2/1, 3/1, 3/2, 4/1, 1/2, 1/3, or 1/4 twill weaves. In certain embodiments of the invention, such as when the fabric material is formed from two or more pluralities or different types of yarns, the yarns are disposed in a pattern-wise arrangement in which one of the yarns is predominantly disposed on one surface of the fabric material. In other words, one surface of the fabric material is predominantly formed by one yarn type. Suitable pattern-wise arrangements or constructions that provide such a fabric material include, but are not limited to, satin weaves, sateen weaves, and twill weaves in which, on a single surface of the fabric, the fill yarn floats and the warp yarn floats are of different lengths.

In another embodiment, the fabric 100 is a knit fabric, for example a circular knit, reverse plaited circular knit, double knit, single jersey knit, two-end fleece knit, three-end fleece knit, terry knit or double loop knit, weft inserted warp knit, warp knit, and warp knit with or without a micro-denier face.

In another embodiment, the fabric 100 is a multi-axial, such as a tri-axial fabric (knit, woven, or non-woven). In another embodiment, the fabric 100 is a bias fabric. In another embodiment, the fabric is a unidirectional fabric and may have overlapping yarns or may have gaps between the yarns.

In another embodiment, the fabric 100 is a non-woven fabric. The term "non-woven" refers to structures incorporating a mass of yarns or fibers that are entangled and/or heat fused so as to provide a coordinated structure with a degree of internal coherency. Non-woven fabrics may be formed from many processes such as for example, meltspun processes, hydroentangeling processes, mechanically entangled processes, stitch-bonding processes and the like.

The fabric 100 contains any suitable yarns. "Yarn", in this application, as used herein includes a monofilament elongated body, a multifilament elongated body, ribbon, strip, yarn, tape, fiber and the like. The fabric 100 may contain one type of yarn or a plurality of any one or combination of the above. The yarns may be of any suitable form such as spun staple yarn, monofilament, or multifilament, single component, bi-component, or multi-component, and have any suitable cross-section shape such as circular, multi-lobal, square or rectangular (tape), and oval.

The fabric 100 can be formed from a single plurality or type of yarn (e.g., the fabric can be formed solely from yarns comprising a blend of cellulosic fibers and synthetic fibers, such as polyamide fibers), or the fabric can be formed from several pluralities or different types of yarns (e.g., the fabric can be formed from a first plurality of yarns comprising cellulosic fibers and polyamide fibers and a second plurality of yarns comprising an inherent flame resistant fiber). In one preferred embodiment, the fibers in the fabric may include filament nylon, and polyester and spun nylon, polyester, cotton, SPANDEX® (or other elastic fibers) and/or NOMEX©.

Preferably, the fabric comprises cellulosic fibers. As utilized herein, the term "cellulosic fibers" refers to fibers composed of, or derived from, cellulose. Examples of suitable cellulosic fibers include cotton, rayon, linen, jute, hemp, cellulose acetate, and combinations, mixtures, or blends thereof. Preferably, the cellulosic fibers comprise cotton fibers.

In those embodiments in which the fabric comprises cellulosic fibers, the cellulosic fibers can be present in the fabric in any suitable amount. For example, in certain embodiments, the cellulosic fibers can comprise about 15% or more, about 20% or more, about 25% or more, about 30% or more, or about 35% or more, by weight, of the fibers present in the fabric. While the inclusion of cellulosic fibers can improve the comfort of the fabric (e.g., improve the hand and moisture absorbing characteristics), the exclusive use of cellulosic fibers may affect the durability of the fabric. Accordingly, it may be desirable to use other fibers (e.g., synthetic fibers) in combination with the cellulosic fibers in order to achieve a desired level of durability. Thus, in such embodiments, the cellulosic fibers can comprise about 95% or less or about 90% or less, by weight, of the fibers present in the fabric. More specifically, in certain embodiments, the cellulosic fibers can comprise about 15% to about 95%, about 20% to about 95%, about 25% to about 95%, about 30% to about 95%, or about 30% to about 90%, by weight, of the fibers present in the fabric material.

In certain embodiments of the invention, one or more of the yarns in the fabric can comprise thermoplastic synthetic fibers. For example, the yarn can comprise a blend of cellulosic fibers and thermoplastic synthetic fibers. These thermoplastic synthetic fibers typically are included in the fabric in order to increase its durability. This increased durability of the yarn, in turn, leads to an increased durability for the fabric. Suitable thermoplastic synthetic fibers include, but are not necessarily limited to, polyester fibers (e.g., poly(ethylene terephthalate) fibers, poly(propylene terephthalate) fibers, poly(trimethylene terephthalate) fibers), poly(butylene terephthalate) fibers, and blends thereof), polyamide fibers (e.g., nylon 6 fibers, nylon 6,6 fibers, nylon 4,6 fibers, and nylon 12 fibers), polyvinyl alcohol fibers, an elastic polyester-polyurethane copolymer (SPANDEX©), flame-resistant meta-aramid (NOMEX©) and combinations, mixtures, or blends thereof. In one preferred embodiment, the fabric comprises cotton and nylon yarns. In another embodiment, the fabric comprises nylon and spandex yarns.

In those embodiments in which the fabric comprises thermoplastic synthetic fibers, the thermoplastic synthetic fibers can be present in one of the pluralities or types of yarn used in making the fabric in any suitable amount. In certain preferred embodiments, the thermoplastic synthetic fibers comprise about 65% or less, about 60% or less, or about 50% or less, by weight, of the fibers present in one of the pluralities or types of yarn used in making the fabric material. In certain preferred embodiments, the thermoplastic synthetic fibers comprise about 5% or more or about 10% or more, by weight, of the fibers present in one of the pluralities or types of yarn used in making the fabric material. Thus, in certain preferred embodiments, the thermoplastic synthetic fibers comprise about 0% to about 65% (e.g., about 5% to about 65%), about 5% to about 60%, or about 10% to about 50%, by weight, of the fibers present in one of the pluralities or types of yarn used in making the fabric material.

In one preferred embodiment, the fabric comprises a plurality of yarns comprising a blend of cellulosic fibers and synthetic fibers (e.g., synthetic staple fibers). In this embodiment, the synthetic fibers can be any of those described above, with polyamide fibers (e.g., polyamide staple fibers) being particularly preferred. In such an embodiment, the cellulosic fibers comprise about 30% to about 90% (e.g., about 40% to about 90%, about 50% to about 90%, about 70% to about 90%, or about 75% to about 90%), by weight, of the fibers present in the yarn, and the polyamide fibers comprise about 10% to about 50% (e.g., about 10% to about 40%, about 10% to about 35%, about 10% to about 30%, or about 10% to about 25%), by weight, of the fibers present in the yarn. In one preferred embodiment, the fabric contains an 80/20 blend of nylon and cotton, sometimes referred to as NyCo fabric.

Certain embodiments of the fabric of the invention contain yarns comprising inherent flame resistant fibers. As utilized herein, the term "inherent flame resistant fibers" refers to synthetic fibers which, due to the chemical composition of the material from which they are made, exhibit flame resistance without the need for an additional flame retardant treatment. In such embodiments, the inherent flame resistant fibers can be any suitable inherent flame resistant fibers, such as polyoxadiazole fibers, polysulfonamide fibers, poly(benzimidazole) fibers, poly(phenylenesulfide) fibers, meta-aramid fibers, para-aramid fibers, polypyridobisimidazole fibers, polybenzylthiazole fibers, polybenzyloxazole fibers, melamine-formaldehyde polymer fibers, phenol-formaldehyde polymer fibers, oxidized polyacrylonitrile fibers, polyamide-imide fibers and combinations, mixtures, or blends thereof. In certain embodiments, the inherent flame resistant fibers are preferably selected from the group consisting of polyoxadiazole fibers, polysulfonamide fibers, poly(benzimidazole) fibers, poly(phenylenesulfide) fibers, meta-aramid fibers, para-aramid fibers, and combinations, mixtures, or blends thereof.

The inherent flame resistant fibers can be present in the fabric in any suitable amount. Generally, the amount of inherent flame resistant fibers included in the fabric will depend upon the desired properties of the final fabric. In certain embodiments, the inherent flame resistant fibers can comprise about 20% or more, about 25% or more, about 30% or more, about 35% or more, about 40% or more, or about 45% or more, by weight, of the fibers present in the fabric. In certain embodiments, the inherent flame resistant fibers can comprise about 75% or less, about 70% or less, about 65% or less, about 60% or less, about 55% or less, about 50% or less, about 45% or less, or about 40% or less, by weight, of the fibers present in the fabric. Thus, in certain embodiments, the inherent flame resistant fibers can comprise about 20% to about 70%, about 25% to about 75% (e.g., about 25% to about 60%, about 25% to about 50%, about 25% to about 45%, or about 25% to about 40%), about 30% to about 70%, about 35% to about 65%, about 40% to about 60%, or about 45% to about 55%, by weight, of the fibers present in the fabric.

Referring back to FIG. 1, the camouflage pattern 200 contains at least three colors; a first color 210, a second color 220, and a third color 230. In another embodiment, the camouflage pattern only contains 2 colors. In another embodiment, the camouflage pattern contains at least 4 colors. In another embodiment, the camouflage pattern contains at least 5 colors. In another embodiment, the camouflage pattern contains at least 6 colors. In another embodiment, the camouflage pattern contains at least 7 colors.

Each of the first, second, and third colors comprise at least one dye. Each of the first, second, and third colors may contain one dye or multiple dyes depending on the color and reflectances desired. The types of dyes used are also selected to coordinate with the materials forming the fabric 100. The dyes may be any suitable dye, for example an acid dye, a disperse dye, a vat dye, a reactive dye, and mixtures thereof.

In one embodiment, the fabric comprises nylon yarns and the dyes comprise acid dyes. In another embodiment, the fabric comprises polyester yarns and the dyes comprise disperse dyes. In another embodiment, the fabric comprises natural yarns and the dyes comprise vat dyes. In another embodiment, the fabric comprises natural yarns and the dyes comprise reactive dyes.

At least one of the first 210, second 220, and third 230 colors in the camouflage pattern contain carbon black. It has been found that carbon black is readily miscible with water and easily goes in the color paste. Carbon black is adjustable from color to color in varying amounts, depending on the requirements of the desired curves. The carbon black can be used as a shading component in place of a blue dyestuff in the case of lighter colors where the two may compete for the overall color match. The acrylic polymer that holds the carbon black in place is cross linked during the printing step, thereby removing the need for an additional processing step. In one embodiment, the amount of carbon black in each color that contains carbon black is between about 0.5 and 100 grams per kilogram of the color.

In one embodiment, all of the colors within the camouflage pattern 200 contain at least one dye and carbon black. This may be preferred to tailor the reflectance of the colors within the visible and/or SWIR ranges. In one embodiment, the amount of carbon black in each color is between about 0.5 and 100 grams per kilogram of the color.

The paste for colors (210, 220, 230) may contain any additional additives such as thickeners, dispersants, or pH adjusters or other suitable additives.

It is becoming increasingly important to have camouflage extend out through the entire SWIR portion of the spectrum. It is desirable to have 2 and more preferably 3 distinct reflectance zones across the SWIR so that the fabric is broken up into a camouflage pattern versus being one large area with the same reflectance.

Preferably, the camouflage pattern has three reflectance zones through the SWIR region. Percentage points means % points on the y axis of a wavelength versus % reflectance chart. 50% and 60% are 10 percentage points away from each other.

The first reflectance zone has a first lower reflectance zone boundary and a first upper reflectance zone boundary and the difference between the upper and lower first reflectance zone boundaries is approximately 10 percentage points. An example of a first reflectance zone can be seen in FIG. 2.

The second reflectance zone has a second lower reflectance zone boundary and a second upper reflectance zone boundary and the difference between the upper and lower second reflectance zone boundaries is approximately 10 percentage points. An example of a second reflectance zone can be seen in FIG. 3.

The third reflectance zone has a third lower reflectance zone boundary and a third upper reflectance zone boundary and the difference between the upper and lower third reflectance zone boundaries is approximately 10 percentage points. An example of a third reflectance zone can be seen in FIG. 4.

Figure 2:
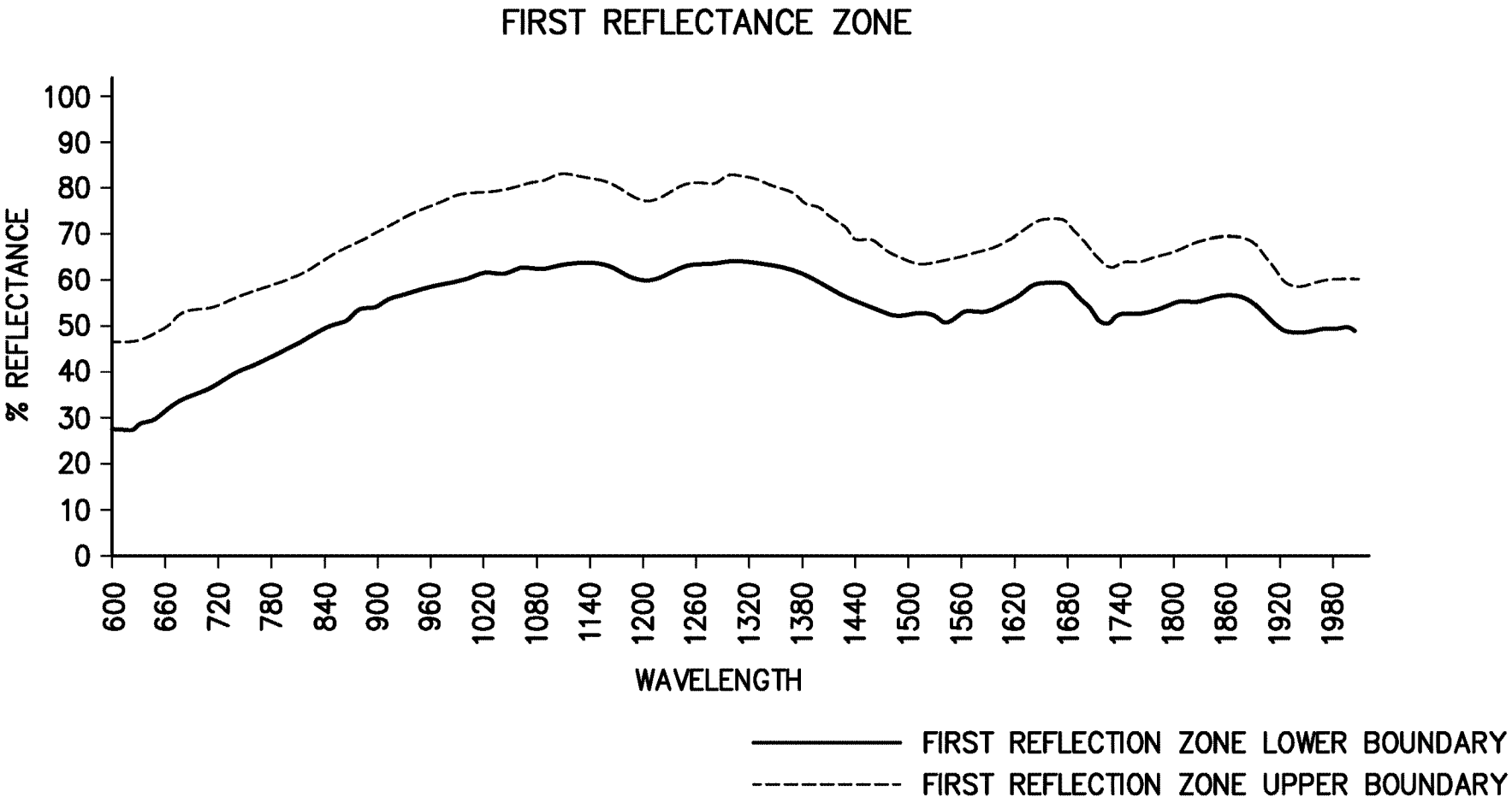
FIG. 2 shows a chart showing one embodiment of a first reflectance zone across the SWIR region.
Figure 3:
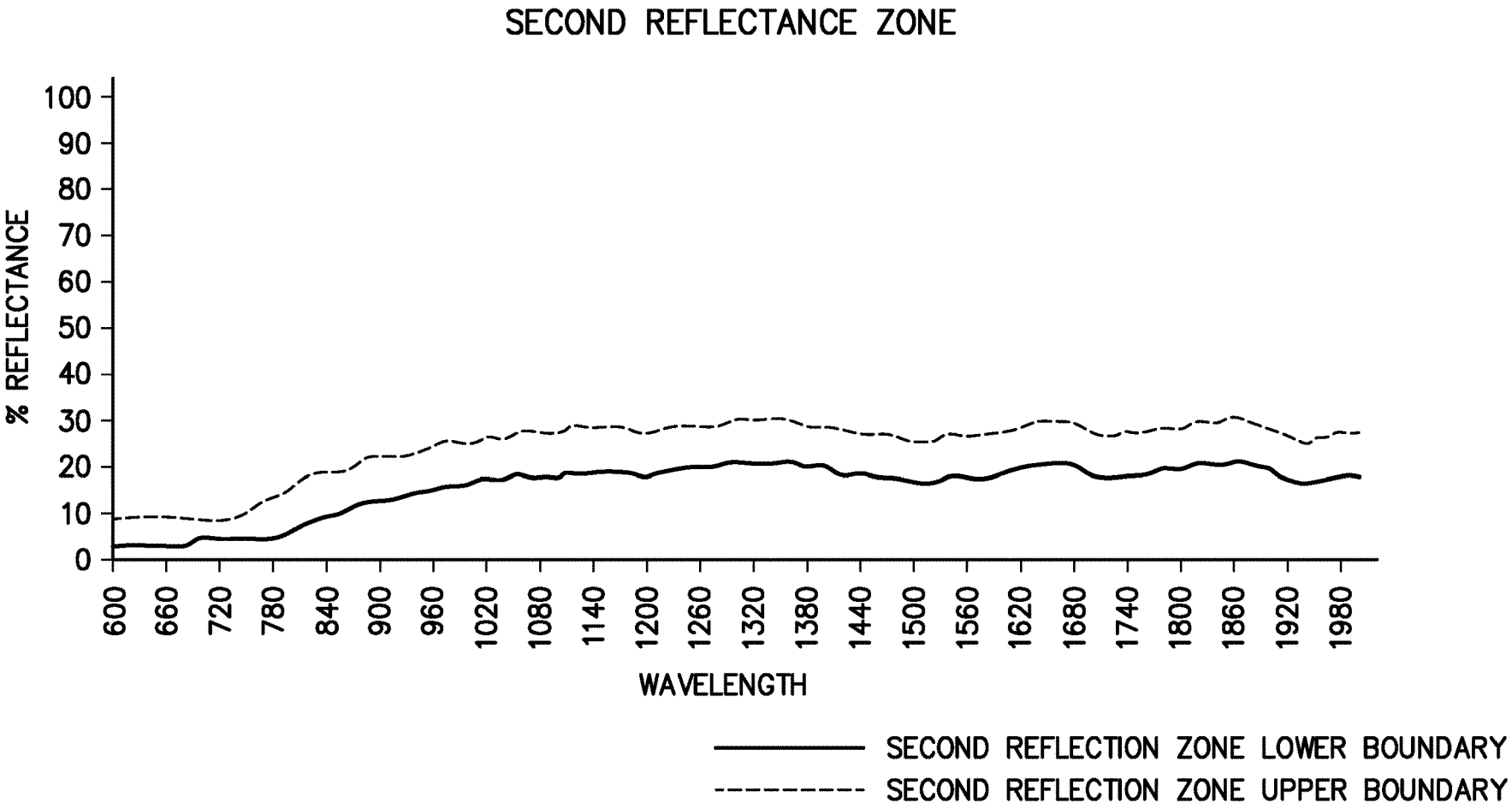
FIG. 3 shows a chart showing one embodiment of a second reflectance zone across the SWIR region.
Figure 4:
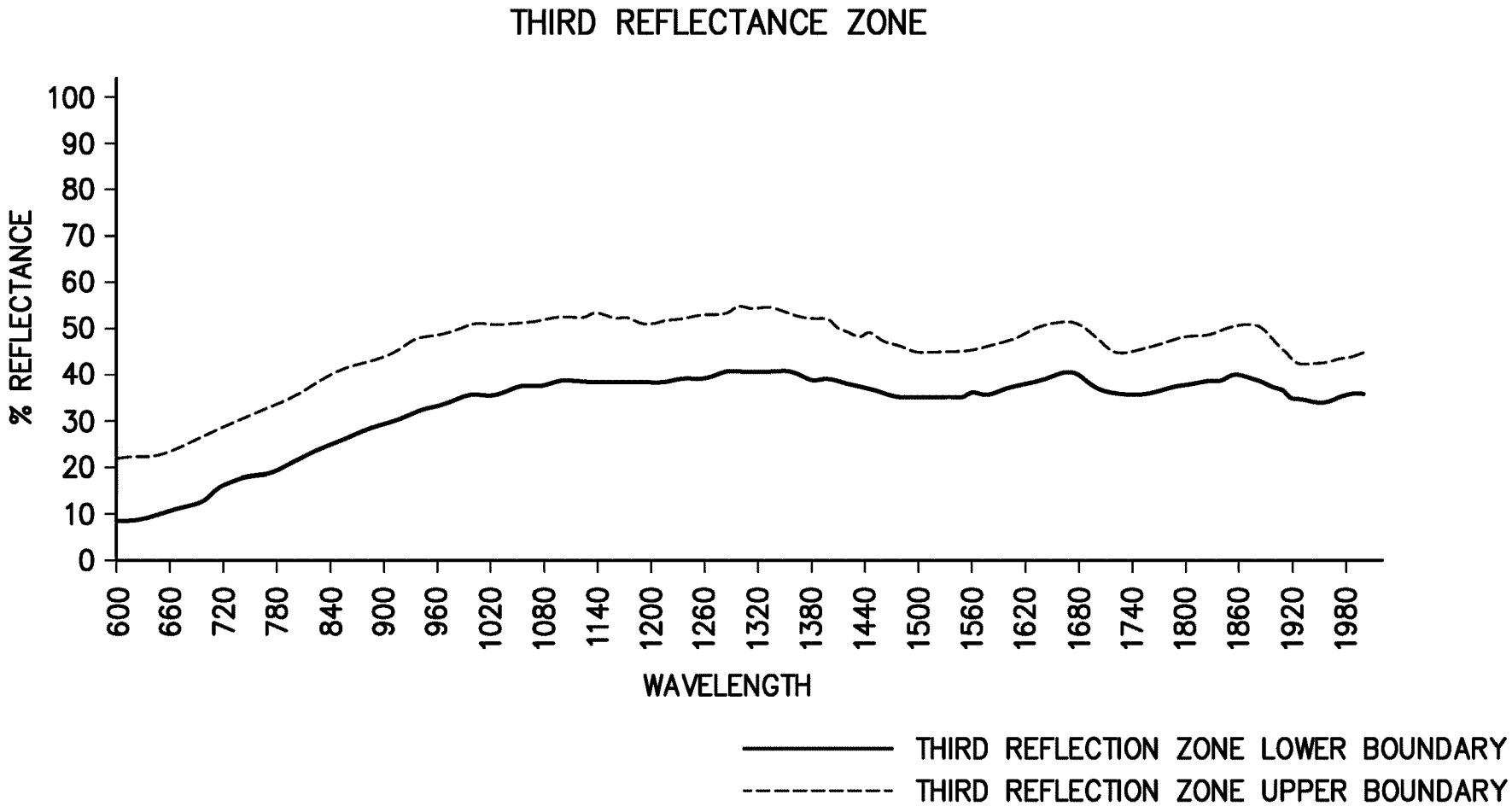
FIG. 4 shows a chart showing one embodiment of a third reflectance zone across the SWIR region.
Figure 5:
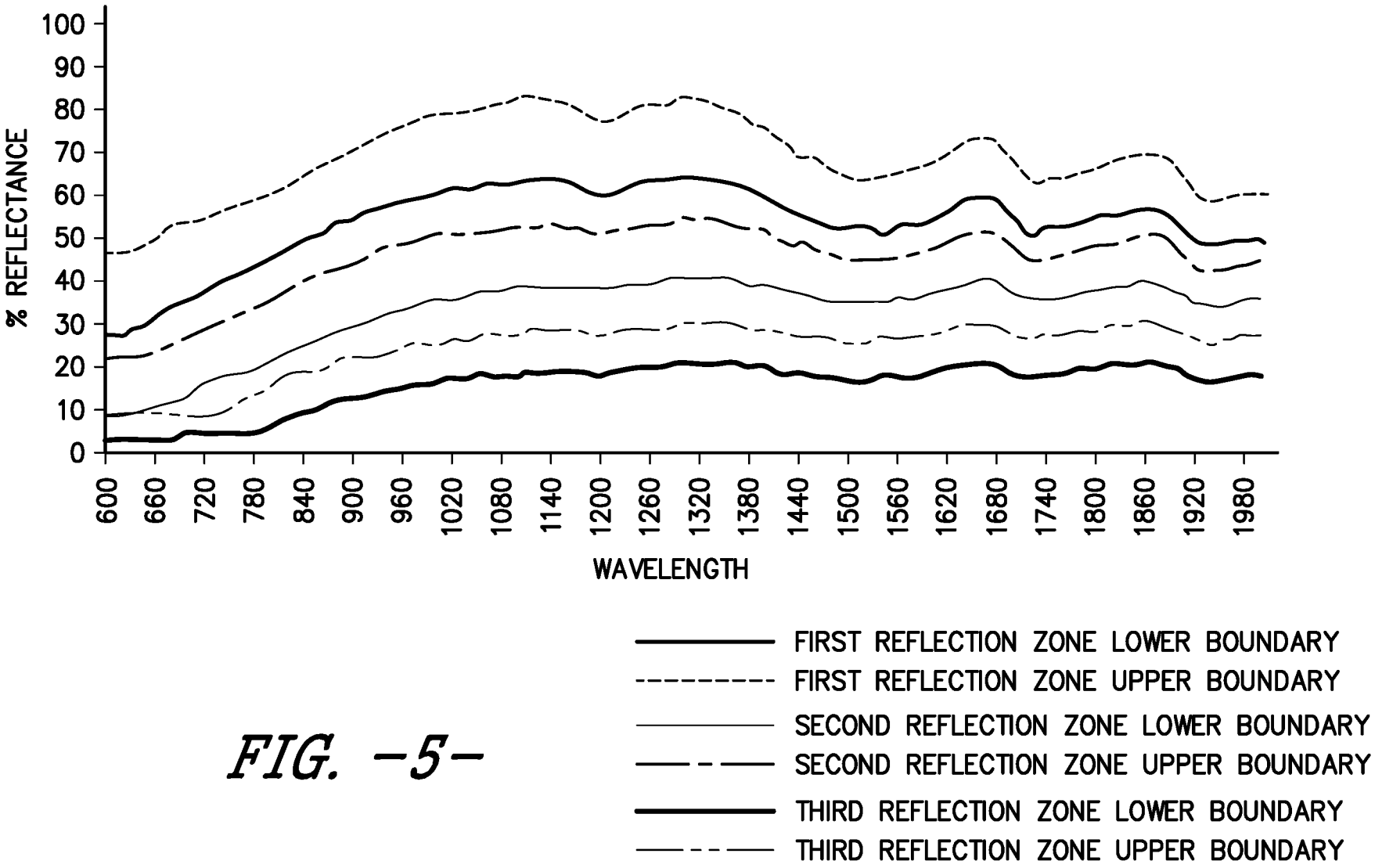
FIG. 5 shows a chart showing one embodiment of first, second, and third reflectance zones across the SWIR region.

FIG. 5 shows all the reflectance zones of FIGS. 2-4 superimposed on one chart. As one can see from FIGS. 2-5, the % reflectance versus wavelength does not have to be a straight line, but the percentage point difference between the upper and lower zones is always approximately 10 percentage points.

Also very important is the distance between the zones. If the zones are not separated all of the way through the SWIR region, then the camouflage effect is lost in the SWIR region. The space between the zones (from the upper boundary of one zone to the lower boundary of the next zone) is approximately 10 percentage points. This amount of separation has been found to be sufficient to create good camouflage effects in the SWIR region. The difference between the first upper reflectance zone boundary and the second lower reflectance zone boundary is approximately 10 percentage points and the difference between the second upper reflectance zone boundary and the third lower reflectance zone boundary is approximately 10 percentage points. If there was a fourth reflectance zone it would have to be approximately 10 percentage points above the first reflectance zone or 10 percentage points below the third reflectance zone.

At essentially all wavelengths within the SWIR portion of the spectrum, the first color falls between the first lower and upper reflectance zone boundaries, the second color falls between the second lower and upper reflectance zone boundaries, and the third color falls between the third lower and upper reflectance zone boundaries. "Essentially all", in this application, is defined to mean at least 85% of the wavelengths within the SWIR region (900-2000 nm). In a preferred embodiment, the first color falls between the first lower and upper reflectance zone boundaries, the second color falls between the second lower and upper reflectance zone boundaries, and the third color falls between the third lower and upper reflectance zone boundaries in at least 90% of wavelengths within the SWIR portion of the spectrum.

In one embodiment, the camouflage pattern further comprises a fourth color, wherein the fourth color falls within the upper and lower boundaries of the first second or third reflectance zones at essentially all wavelengths within the SWIR portion of the spectrum. In another embodiment, the camouflage pattern further comprises a fifth color, wherein the fifth color falls within the upper and lower boundaries of the first second or third reflectance zones at essentially all wavelengths within the SWIR portion of the spectrum. In another embodiment, the camouflage pattern further comprises a sixth color, wherein the sixth color falls within the upper and lower boundaries of the first second or third reflectance zones at essentially all wavelengths within the SWIR portion of the spectrum. In another embodiment, all of the colors of the camouflage pattern fall within the upper and lower boundaries of the first second or third reflectance zones at essentially all wavelengths within the SWIR portion of the spectrum. The camouflage fabric preferably contains between 4 and 7 colors and preferably each of those colors fall within the upper and lower boundaries of the first second or third reflectance zones at essentially all wavelengths within the SWIR portion of the spectrum As one can see from FIG. 7 of U.S. Pat. No. 8,932,965 (Wendel, Dale R. issued Jan. 13, 2015), which is a chart from Example 5—Woodland Camo, the colors remain somewhat separated until about 1400 or 1500 nm where at which point the colors all converge. This would not work as a camouflage fabric for the SWIR region.

The multispectral camouflage fabric may be used as a fabric or may undergo further operations to become a finished good. The fabric may be used for any article where camouflage in the VIS, NIR, and/or SWIR is desired such as articles of clothing, tents, structures, camouflage to cover objects and more. As a garment, the fabric may be used for any suitable garment including, but not limited to, pants, shirts, outerwear such as jackets, shoes, hats, scarves, and belts. In one preferred embodiment, the multispectral camouflage fabric is made into a fabric article. In another preferred embodiment, the multispectral camouflage fabric is made into a garment.

Example 1

Example 1 was a printed camouflage fabric. The fabric was a plain weave, rip stop woven fabric made from yarns containing a 52%/48% blend of nylon and cotton fibers.

A camouflage pattern was printed on the first side of the fabric and the camouflage pattern contained 7 colors. All colors were made with selected Dystar Vat dyes from the group consisting of Indanthren Olive T, Indanthren Brown HRR, Indanthren Black G, Indanthren Yellow F3GC, Indanthren Olive R, and Indanthren Brilliant Green FFB. All colors had some amount of carbon black added to meet the desired SWIR reflectances.

| Color Number | Color Name | Contained at Least One Dye | Contained Carbon Black |
|---|---|---|---|
| 1 | Dark Cream 559 | Yes | Yes |
| 2 | Tan 525 | Yes | Yes |
| 3 | Light Sage 560 | Yes | Yes |
| 4 | Olive 527 | Yes | Yes |
| 5 | Dark Green 528 | Yes | Yes |
| 6 | Brown 529 | Yes | Yes |
| 7 | Bark Brown 561 | Yes | Yes |

Figure 6:
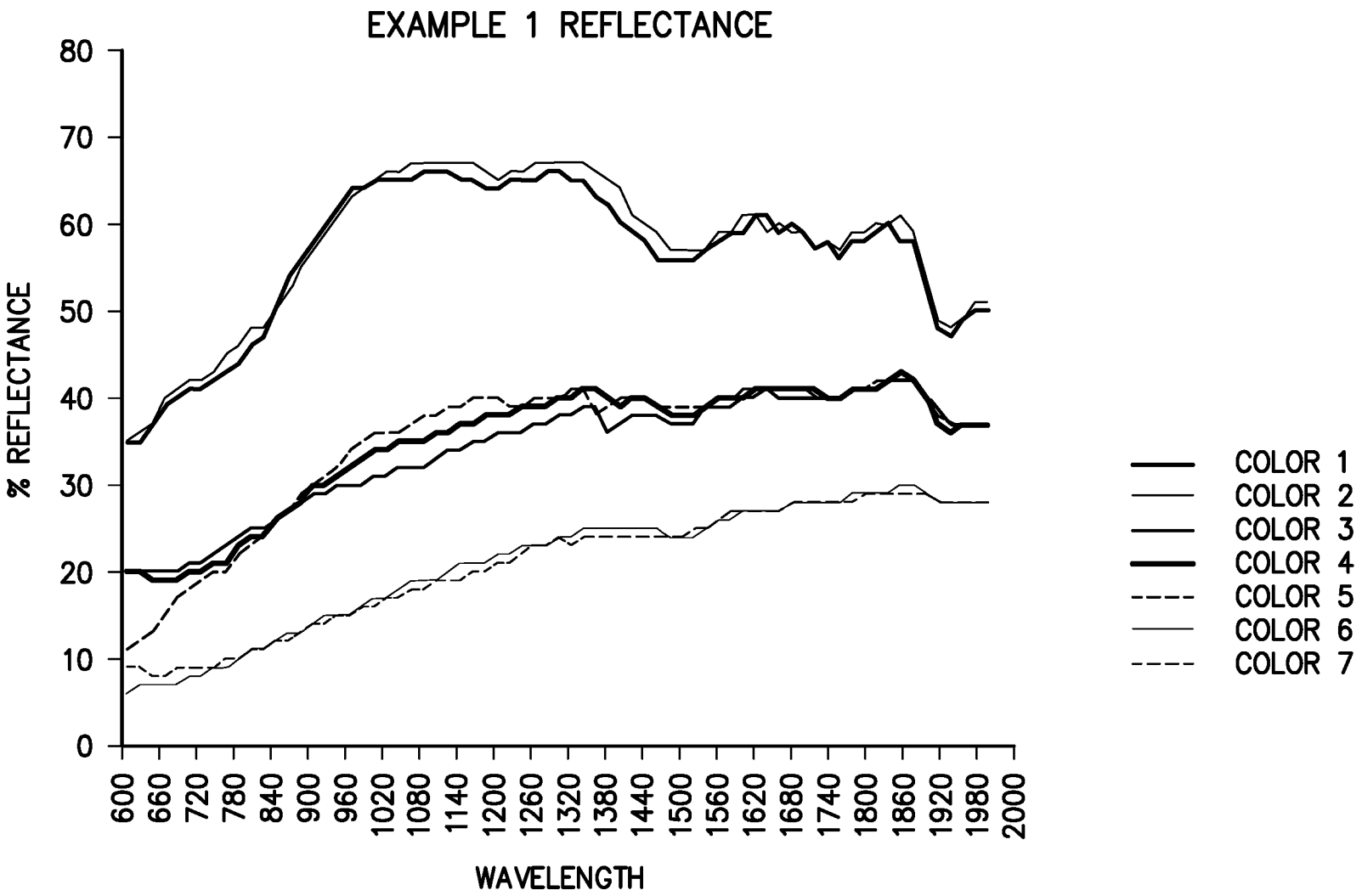
FIG. 6 shows the reflectance of the multispectral camouflage fabric of Example 1.

The reflectance of the multispectral camouflage fabric was tested and is shown in FIG. 6. One can see that Colors 1 and 2 would be in the first reflectance zone, Colors 3, 4, and 5 would be in the second reflectance zone, and Colors 6 and 7 would be in the third reflectance zone. The separation between the groups of colors 1-2, 3-5, and 6-7 throughout essentially all of the wavelengths within the SWIR regions produce a good camouflage fabric for the SWIR region.

All references, including publications, patent applications, and patents, cited herein are hereby incorporated by reference to the same extent as if each reference were individually and specifically indicated to be incorporated by reference and were set forth in its entirety herein.

The use of the terms "a" and "an" and "the" and similar referents in the context of describing the subject matter of this application (especially in the context of the following claims) are to be construed to cover both the singular and the plural, unless otherwise indicated herein or clearly contradicted by context. The terms "comprising," "having," "including," and "containing" are to be construed as open-ended terms (i.e., meaning "including, but not limited to,") unless otherwise noted. Recitation of ranges of values herein are merely intended to serve as a shorthand method of referring individually to each separate value falling within the range, unless otherwise indicated herein, and each separate value is incorporated into the specification as if it were individually recited herein. All methods described herein can be performed in any suitable order unless otherwise indicated herein or otherwise clearly contradicted by context. The use of any and all examples, or exemplary language (e.g., "such as") provided herein, is intended merely to better illuminate the subject matter of the application and does not pose a limitation on the scope of the subject matter unless otherwise claimed. No language in the specification should be construed as indicating any non-claimed element as essential to the practice of the subject matter described herein.

Preferred embodiments of the subject matter of this application are described herein, including the best mode known to the inventors for carrying out the claimed subject matter. Variations of those preferred embodiments may become apparent to those of ordinary skill in the art upon reading the foregoing description. The inventors expect skilled artisans to employ such variations as appropriate, and the inventors intend for the subject matter described herein to be practiced otherwise than as specifically described herein. Accordingly, this disclosure includes all modifications and equivalents of the subject matter recited in the claims appended hereto as permitted by applicable law. Moreover, any combination of the above-described elements in all possible variations thereof is encompassed by the present disclosure unless otherwise indicated herein or otherwise clearly contradicted by context.

What is claimed is:

1. A multispectral camouflage fabric comprising:

a fabric having a first side and a second side;

a camouflage pattern located on top of the first side of the fabric, wherein the camouflage pattern comprises a least a first color paste, a second color paste, and a third color paste, wherein each of the first, second, and third color pastes comprise at least one dye and wherein at least one of the first, second, and third color pastes comprises carbon black, wherein the camouflage pattern comprises a short wave infrared (SWIR) reflectance pattern through the SWIR portion of the spectrum defined to be between 900 and 2000 nm, wherein the SWIR reflectance pattern comprises:

a first reflectance zone having a first reflectance zone lower boundary and a first reflectance zone upper boundary, wherein the difference between the upper and lower first reflectance zone boundaries is 10 percentage points;

a second reflectance zone having a second reflectance zone lower boundary and a second reflectance zone upper boundary, wherein the difference between the upper and lower second reflectance zone boundaries is 10 percentage points;

a third reflectance zone having a third reflectance zone lower boundary and a third reflectance zone upper boundary, wherein the difference between the upper and lower third reflectance zone boundaries is 10 percentage points;

wherein the difference between the second reflectance zone upper boundary and the first reflectance zone lower boundary is 10 percentage points and the difference between the third reflectance zone upper boundary and the second reflectance zone lower boundary is 10 percentage points;

wherein in at least 85% of the wavelengths within the SWIR portion of the spectrum, the first color paste falls between the first reflectance zone lower and upper boundaries, the second color paste falls between the second reflectance zone lower and upper boundaries, and the third color paste falls between the third reflectance zone lower and upper boundaries.

2. The multispectral camouflage fabric of claim 1, wherein the camouflage pattern further comprises a fourth color paste, wherein the fourth color paste fall within the upper and lower boundaries of the first second or third reflectance zones at essentially all wavelengths within the SWIR portion of the spectrum.

3. The multispectral camouflage fabric of claim 2, wherein the camouflage pattern further comprises a fifth color paste, wherein the fifth color paste fall within the upper and lower boundaries of the first second or third reflectance zones at essentially all wavelengths within the SWIR portion of the spectrum.

4. The multispectral camouflage fabric of claim 3, wherein the camouflage pattern further comprises a sixth color paste, wherein the sixth color paste fall within the upper and lower boundaries of the first second or third reflectance zones at essentially all wavelengths within the SWIR portion of the spectrum.

5. The multispectral camouflage fabric of claim 3, wherein all of the color pastes of the camouflage pattern fall within the upper and lower boundaries of the first second or third reflectance zones at essentially all wavelengths within the SWIR portion of the spectrum.

6. The multispectral camouflage fabric of claim 1, wherein at least 2 of the color pastes of the camouflage pattern comprise at least one dye and carbon black.

7. The multispectral camouflage fabric of claim 1, wherein all of the color pastes of the camouflage pattern comprise at least one dye and carbon black.

8. The multispectral camouflage fabric of claim 1, wherein the at least one dye of each color paste is selected from the group consisting of an acid dye, a disperse dye, a vat dye, a reactive dye, and mixtures thereof.

9. The multispectral camouflage fabric of claim 1, wherein the fabric comprises nylon yarns and the dyes comprise acid dyes.

10. The multispectral camouflage fabric of claim 1, wherein the fabric comprises polyester yarns and the dyes comprise disperse dyes.

11. The multispectral camouflage fabric of claim 1, wherein the fabric comprises natural yarns and the dyes comprise vat dyes.

12. The multispectral camouflage fabric of claim 1, wherein the fabric comprises natural yarns and the dyes comprise reactive dyes.

13. The multispectral camouflage fabric of claim 1, wherein the amount of carbon black in each color paste is between about 0.5 and 100 grams per kilogram of the color.

14. A garment made from the multispectral camouflage fabric of claim 1.

15. A fabric article made from the multispectral camouflage fabric of claim 1.

* * * * *